United States Patent [19]

Marker

[11] 4,203,614

[45] May 20, 1980

[54] SAFETY SKI BINDING

[76] Inventor: Hannes Marker, Hauptstrasse 51-53, 81 Garmisch-Partenkirchen, Fed. Rep. of Germany

[21] Appl. No.: 924,347

[22] Filed: Jul. 13, 1978

[30] Foreign Application Priority Data

Jul. 15, 1977 [DE] Fed. Rep. of Germany ..... 2732120

[51] Int. Cl.[2] ..... A63C 9/08

[52] U.S. Cl. ..... 280/637; 280/618

[58] Field of Search ..... 280/637, 618, 613, 617

[56] References Cited

U.S. PATENT DOCUMENTS

| | | | |
|---|---|---|---|
| 3,897,077 | 7/1975 | Schmeizer | 280/637 |
| 4,026,577 | 5/1977 | Frechin | 280/637 |

*Primary Examiner*—Robert R. Song

*Attorney, Agent, or Firm*—Fleit & Jacobson

[57] ABSTRACT

A cable is connected at one end to the skiing boot and at the other end to the ski. Detent elements are provided to hold the skiing boot in skiing position on the ski. A mounting fixture is secured to the ski approximately in the middle portion thereof and is connected to the cable. A tensioner is connected to the cable and causes the latter to hold the detent elements in engagement with each other. A single detent device is provided, which comprises a one-base or two-base segment of a sphere or ellipsoid and a mating cap. The cable extends at the center of one detent element and through the center of the other detent element. The tensioner always loads the cable, in a manner known per se. Where the detent device comprises a segment of a sphere, said segment has at least one protection and the cap has a mating interior recess.

13 Claims, 2 Drawing Figures

SAFETY SKI BINDING

Figure 1:
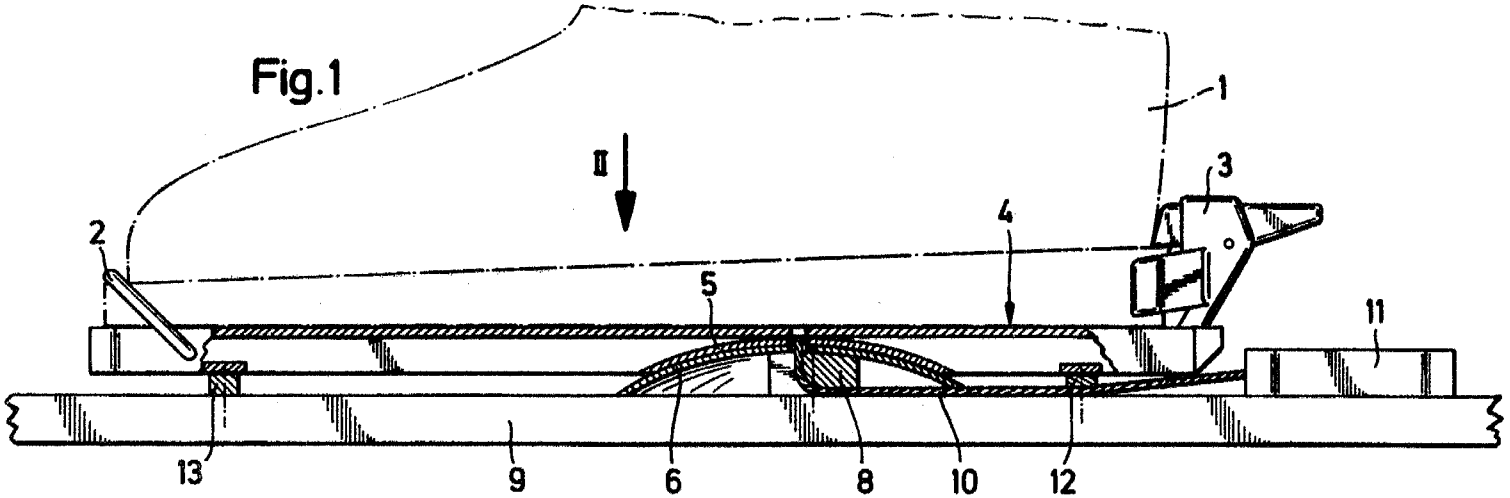

This invention relates to a safety ski binding comprising a cable which is connected at one end to the skiing boot and at the other end to the ski, detent elements for holding the skiing boot in skiing position on the ski, a mounting fixture, which is secured to the ski approximately in the middle portion thereof and connected to the cable, and a tensioner, which is connected to the cable and causes the latter to hold the detent elements in engagement with each other.

In one safety ski binding of that type the skiing boot is detachably secured to a soleplate and the tensioner comprise a tightener, which is provided with a release mechanism and by means of the cable holds the skiing boot on the ski through the intermediary of four detent devices, which consist of conical or spherical pins fixed to the ski and mating openings in the soleplate. That end of the cable which is connected to the soleplate is provided with a disc, which is slidably and rotatably mounted in a slot of the soleplate. An important disadvantage of that ski binding resides in that after a release of the ski binding, e.g., after a fall of the skier, the cable like a retaining strap continues to connect the ski to the skier's foot and there is a considerable risk of injury to the skier by the ski which is hurled through the air. A further disadvantage resides in that it is extremely difficult for the skier to step into the binding after a release, particularly on a slope, because the detent elements must be caused to interengage before the tightener can be operated to fix the boot and it is difficult to manipulate the detent elements as they are not visible when the skiing boot has been placed on the ski.

Another known ski binding of the type described first comprises a central conical detent element and two cables, which are eccentrically connected to the detent element and are always loaded by respective tensioners in such a manner that after a release the ski is automatically re-connected to the skiing boot when the forces which have caused a limited release of the skiing boot have decreased. An important disadvantage of the last-mentioned ski binding resides in the provision of two cables because the skiing boot is lifted to some extent when a fall of the skier gives rise to strong forces tending to effect a release and the cables may then twist around each other and prevent an automatic re-engagement of the detent elements. Another important disadvantage resides in the fact that the two cables exert eccentric forces on the detent element. It is essential that the holding torques acting on the detent element are equal. Unequal holding torques may be due to different tensile forces exerted by the cables and by inaccurately secured reversing pulleys and will result in a rotation from the longitudinal axis of the ski and in a turning of the skiing boot about its vertical axis on the ski. It has been attempted to solve this problem by a most expensive design of the ski bindings just described so that their manufacturing costs are high and the bindings are liable to be deranged.

It is an object of the invention to provide a safety binding which avoids the disadvantages of these known ski bindings.

In a safety ski binding comprising a cable which is connected to one end to the skiing boot and at the other end to the ski, detent elements for holding the skiing boot in skiing position on the ski, a mounting fixture, which is secured to the ski approximately in the middle portion thereof and connected to the cable, and a tensioner which is connected to the cable and causes the latter to hold the detent elements in engagement with each other, this object is accomplished according to the invention in that a single detent device is provided, which comprises a one- or two-base segment of a sphere or ellipsoid and a mating cap, that the cable extends at the center of one detent element and through the center of the other detent element, that the tensioner always loads the cable, in a manner known per se, and that where the detent device comprises a segment of a sphere said segment has at least one projection and the cap has a mating interior recess.

Because the ski disengages the sole of the boot only for the short time in which the force applied exceeds the force required for the release, e.g., in case of a fall of the skier, there is virtually no risk of an injury of the skier by the ski. Besides, the cable cannot be twisted together with a second cable and the automatic fixation and renewed connection between the skiing boot and the ski are reliably ensured.

In a first embodiment of the safety ski binding according to the invention the mounting fixture is non-detachably connected to the skiing boot and is arbitrarily detachably connected to that detent element (segment or cap) which is connected to the skiing boot. In that case the skiing boot facilitates walking because the cap is provided on the mounting fixture.

In a preferred second embodiment of the safety ski binding according to the invention the mounting fixture for the skiing boot is arbitrarily detachably connected to the skiing boot. This embodiment will permit of a simple design if the mounting fixture is a binding plate known per se. The cap may be secured to the mounting fixture for the skiing boot or to the ski.

In a simple embodiment having a low overall height, the tensioner is secured to the ski.

In a compact binding having no parts disposed in front of or behind the skiing boot, the tensioner is firmly connected to the detent element which is secured to the skiing boot.

A cable tensioner designed to exert a degressive retaining force will meet in a simple manner the requirements for a strong retaining force and a less strong retracting force.

To enable a setting of different retaining forces, the tensioner is suitably provided with an adjusting device.

In an advantageous embodiment of the safety ski binding according to the invention, a fulcrum bar is secured to the ski for engagement by the forward portion of the skiing boot.

Figure 2:
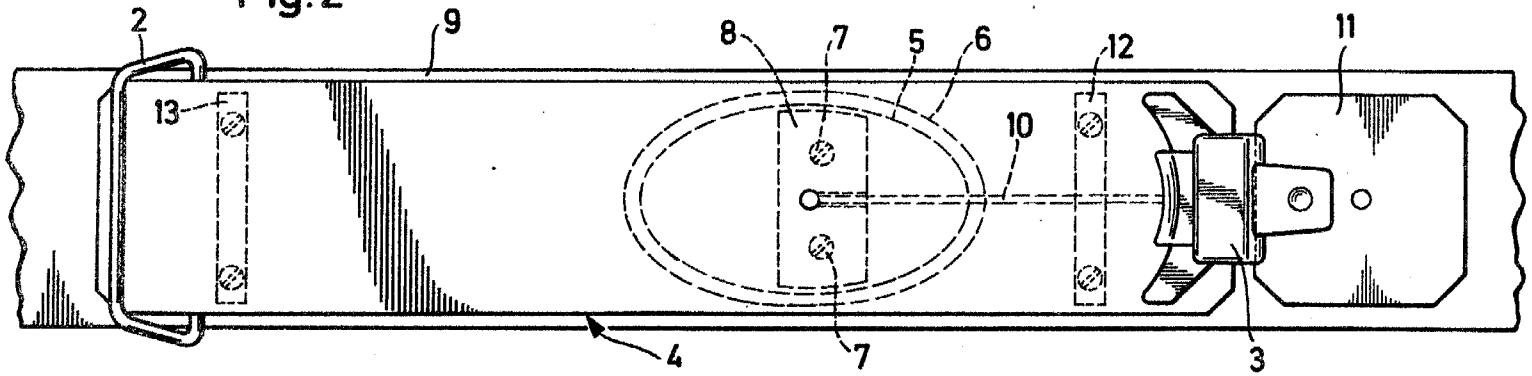

An embodiment of the invention will now be described by way of example with reference to the accompanying drawing, in which FIG. 1 is a side elevation showing a safety ski binding, partly cut open, and FIG. 2 is a top plan view showing the safety ski binding of FIG. 1.

In the illustrated embodiment of the safety ski binding according to the invention, the skiing boot 1, which is indicated in phantom in FIG. 1, is arbitrarily detachably held on a binding plate 4 by means of a forward soleholder 2 and a rear soleholder 3. The underside of the binding plate is releasably locked to the ski 9 approximately on the axis of the tibia of the skier by a detent mechanism which comprises a one-base segment 6 of an ellipsoid and a mating cap 5.

The segment 6 and a guiding member 8 is secured to the ski by screws 7. A cable 10 is looped around the guiding member 8. One end portion of the cable extends through the centers of the segment 6 and of the cap 5 and is secured to the binding plate which carries the cap and which always loads the cable so that the cap 5 is forced onto the segment 6. The cable extends on the upper surface of the ski and is guided by the guiding member 8 and a rear fulcrum bar 12. Another fulcrum bar 13 is secured to the ski adjacent to the forward portion of the binding plate. As a result, the forces exerted during forward and rearward falls act on the prestressed cable by means of defined moment arms.

The fulcrum bars 12, 13 may be additionally coated with a low-friction mat rial, such as polytetrafluoroethylene, so that the sliding friction in case of a twisting fall is minimized.

The retaining force of the cable 10 can be adjusted at the tensioner 11 by known means, not shown.

When the cable 10 is subjected to a force in excess of its retaining force, whether during a forward or rearward or twisting fall, the cable is pulled out of the tensioner only during the action of the said excessive force and only to a limited extent. During a twisting fall the elliptical cap and the elliptical segment will cooperate to extend the cable. As the cable is extended, it is subjected to a tensile force. As sooon as the releasing force decreases, that tensile force pulls back the ski 9 to the soleplate 4 and ensures that the latter will be fixed and releasably locked.

What is claimed is:

1. A safety ski binding for releasably interconnecting a skiing boot and a ski, said binding comprising:

a cable (10) connectable at one end to a skiing boot and at the other end to a ski (9);

a mounting fixture (4) for the skiing boot releasably securable to the ski approximately in a middle portion thereof and connected to said cable;

detent elements (5,6) positioned between said mounting fixture and the ski for holding the skiing boot in skiing position on the ski; and a tensioner (11) connected to said cable for loading said cable to thereby hold said detent elements in engagement with each other, said detent elements comprising a base segment having an at least partially arcuate-shaped exterior surface and a cup having a surface mating with the exterior surface of said base segment, one of said detent elements being connected to the ski and the other detent element being fixedly connected to the mounting fixture, said cable extending from the center of one detent element and through the center of the other detent element.

2. A safety ski binding according to claim 1, characterized in that the mounting fixture is non-detachably connected to the skiing boot and is releasably connected to one of said detent elements connected to the skiing boot.

3. A safety ski binding according to claims 1 or 2, characterized in that the cap is provided on the mounting fixture for the skiing boot.

4. A safety ski binding according to claim 1, characterized in that the mounting fixture for the skiing boot is arbitrarily detachably connected to the skiing boot.

5. A safety ski binding according to claim 4, characterized in that the mounting fixture consists of a binding plate.

6. A safety ski binding according to one of claims 1, 2 or 4, characterized in that the cap is secured to the ski.

7. A safety ski binding according to claim 1, characterized in that the tensioner is secured to the ski.

8. A safety ski binding according to claim 1 or 7, characterized in that the tensioner is non-detachably connected to one of said detent elements connected to the skiing boot.

9. A safety ski binding according to claim 1, characterized in that the tensioner exerts a degressive retaining force on the cable.

10. A safety ski binding according to claim 9, characterized in that the tensioner comprises means for adjusting the retaining force.

11. A safety ski binding according to claim 1, characterized in that a fulcrum bar is secured to the ski for engagement by the forward portion of the skiing boot.

12. A safety ski binding according to one of claims 1, 2, 4, 5, 7, 9, 10 or 11, wherein said base segment comprises a segment of an ellipsoid.

13. A safety ski binding according to one of claims 1, 2, 4, 5, 7, 9, 10 or 11 wherein said base segment comprises a segment of a spheroid having at least one projection extending from the surface thereof, and wherein said cup has an interior recess mating with said projection.

* * * * *